US005519477A

United States Patent [19]

Bell et al.

[11] Patent Number: 5,519,477

[45] Date of Patent: May 21, 1996

[54] POST TRANSFER CORRUGATOR

[75] Inventors: Conrad J. Bell, Webster; Alan B. Amidon, Fairport, both of N.Y.

[73] Assignee: Xerox Corporation, Stamford, Conn.

[21] Appl. No.: 342,478

[22] Filed: Nov. 21, 1994

[51] Int. Cl.[6] ..... G03G 15/20

[52] U.S. Cl. ..... 355/282; 355/309; 355/271

[58] Field of Search ..... 355/273, 271, 355/208, 210, 308, 309, 282; 430/33

[56] References Cited

U.S. PATENT DOCUMENTS

| | | | |
|---|---|---|---|
| 3,893,760 | 7/1975 | Thettu | 355/3 R |
| 4,017,065 | 4/1977 | Poehlein | 271/80 |
| 4,092,021 | 5/1978 | Fletcher | 271/176 |
| 4,369,729 | 1/1983 | Shigenobu et al. | 118/60 |
| 4,769,670 | 9/1988 | Nishise . | |
| 5,023,667 | 6/1991 | Negoro et al. | 355/274 |
| 5,130,752 | 7/1992 | Morishita et al. | 355/274 |
| 5,138,396 | 8/1992 | Satou et al. | 355/308 |
| 5,337,128 | 8/1994 | Hashizume et al. | 355/271 |

*Primary Examiner*—R. L. Moses
*Attorney, Agent, or Firm*—William A. Henry, II

[57] ABSTRACT

A device that addresses the problem of substrate distortion created by a fuser nip being transmitted back to a transfer nip includes a post transfer corrugator that introduces a non-image side protrusion in the substrate path between the transfer zone and the fuser zone. The post transfer corrugator forces the substrate to flatten out any distortion caused by the fuser/nip and prevents this distortion from entering the transfer zone. The corrugator also supports the substrate so as to increase the wrap angle of the substrate around an electrostatic member.

11 Claims, 3 Drawing Sheets

POST TRANSFER CORRUGATOR

Figure 1:
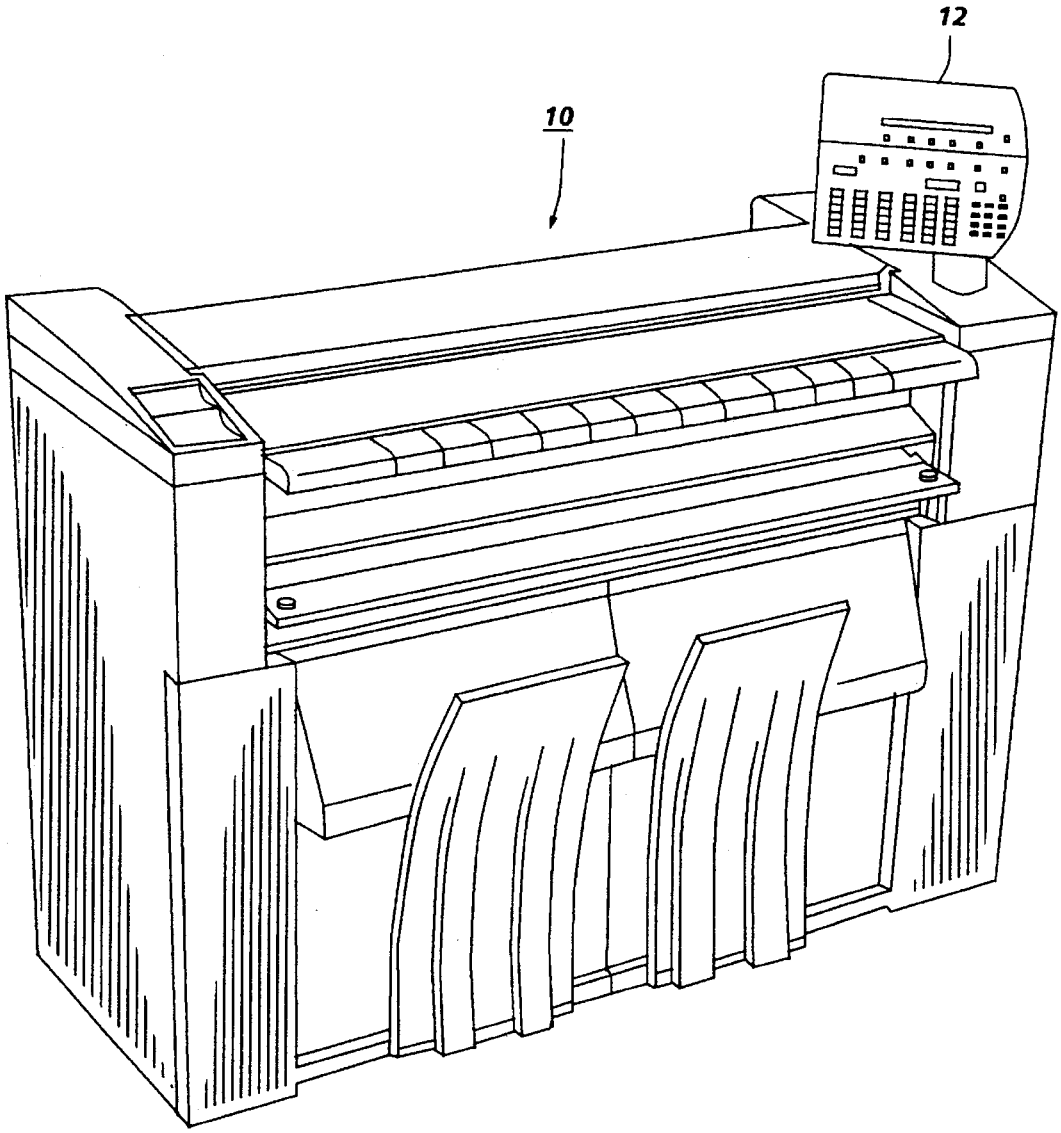

This invention relates to printing machines, and more particularly, to a post transfer corrugator to be used with such machines.

In the art of xerography or other similar image reproducing arts, a latent electrostatic image is formed on a charge-retentive surface such as a photoconductor which generally comprises a photoconductive insulating material adhered to a conductive backing. This photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purpose of the present invention, the latent electrostatic image may be generated from information electronically stored or generated, and the digital information may be converted to alphanumeric images by image generation electronics and optics. However, such image generation electronic and optic devices form no part of the present invention.

A problem has been found when transferring an image to roll fed or cut sheet media that is also being fused at the same time a short distance away. That is, substrate distortion is sometimes created by a fuser nip being transmitted back to the transfer nip. This is especially true for wide body machines that feed large copy sheets (i.e., 11×17", 12×18", 18×24", 24×36" or 36×48", etc.) at low speeds in high humidity environments. The failure mode being what is termed as snake deletions. The fuser will remove moisture from the substrate and in the process cause wrinkles in the substrate copy which in turn creates snake deletions in the direction of process that are about ⅛" to about ¾" wide that meander throughout the copy extending from about 6 inches from the lead edge of a substrate in wide body copier/printers. Removal of these copy image deletion problems is a necessity for customer satisfaction with a given machine.

Various approaches have been devised for answering problems encountered when transporting copy sheets between a transfer station and a fuser station. The following disclosures appear to be relevant:

U.S. Pat. No. 3,893,760 Patentee: Thettu Issued: Jul. 8, 1975

U.S. Pat. No. 4,017,065 Patentee: Poehlein Issued: Apr. 12, 1977

U.S. Pat. No. 4,092,021 Patentee: Fletcher Issued: May 30, 1978

The relevant portions of the foregoing patents are included herein by reference along with the references cited therein and may be summarized as follows:

Thettu (U.S. Pat. No. 3,893,760) discloses an apparatus for preventing externally induced shock waves from being translated by a sheet into an image transfer zone. Damping rollers are positioned at the entrance and exit to the transfer zone that are capable of contacting the sheet so as to uniformly tension the sheet during the image transfer operation.

Poehlein (U.S. Pat. No. 4,017,065) is directed to an electrostatographic copier wherein a fuser roll nip are positioned closer than the dimensions of copy sheets from the image transfer area. Speed mismatch compensation between the fuser roll nip and a copy sheet is provided by intentionally driving the fuser roll nip at a different velocity to form a buckle in the intermediate portion of the copy sheet controlled by selective cyclic reductions in vacuum applied to a configured manifold guide surface.

Fletcher (U.S. Pat. No. 4,017,065) discloses an electrostatographic copier in which a copy sheet bearing an unfused and electrically disturbable image is transported on a conductive vacuum guide member and then removed from the conductive guide member and includes a conductive baffle that is electrically connected and sufficiently closely spaced from the guide member to provide a low electrostatic field zone between the baffle and the guide member for movement therebetween of the copy sheet. The copy sheet is removed from the guide member without electrical disturbance of the image. The opposing baffle and guide member have similar and opposite diverging radii of curvature in the copy removal area. Even with this prior art, there remains the problem of image deletion when transferring an image to roll fed or cut sheet media that is simultaneously being fused a short distance away.

It is therefore an object of this invention to provide a post transfer system that is economical and positions a cut sheet to a fuser for fusing of an image to the sheet without image deletion.

Accordingly, to answer this need and in accordance with the present invention, an image deletion solution is disclosed which comprises a post transfer corrugator that introduces a non-image side protrusion in the substrate path between the transfer zone and the fuser zone. The post transfer corrugator forces the substrate to flatten out any distortions caused by the fuser heat/nip and prevents this distortion from entering the transfer zone. The corrugator also supports the substrate and prevents it from falling away from a photoreceptor which contains an image to be transferred to the substrate.

The accompanying drawings, which are incorporated in and constitute a part of this specification, illustrate a preferred embodiment of the invention and, together with the description, serve to explain the principles of the invention.

FIG. 1 is a perspective view of an exemplary copier/printer apparatus in which the post transfer corrugator of the present invention is used.

Figure 2:
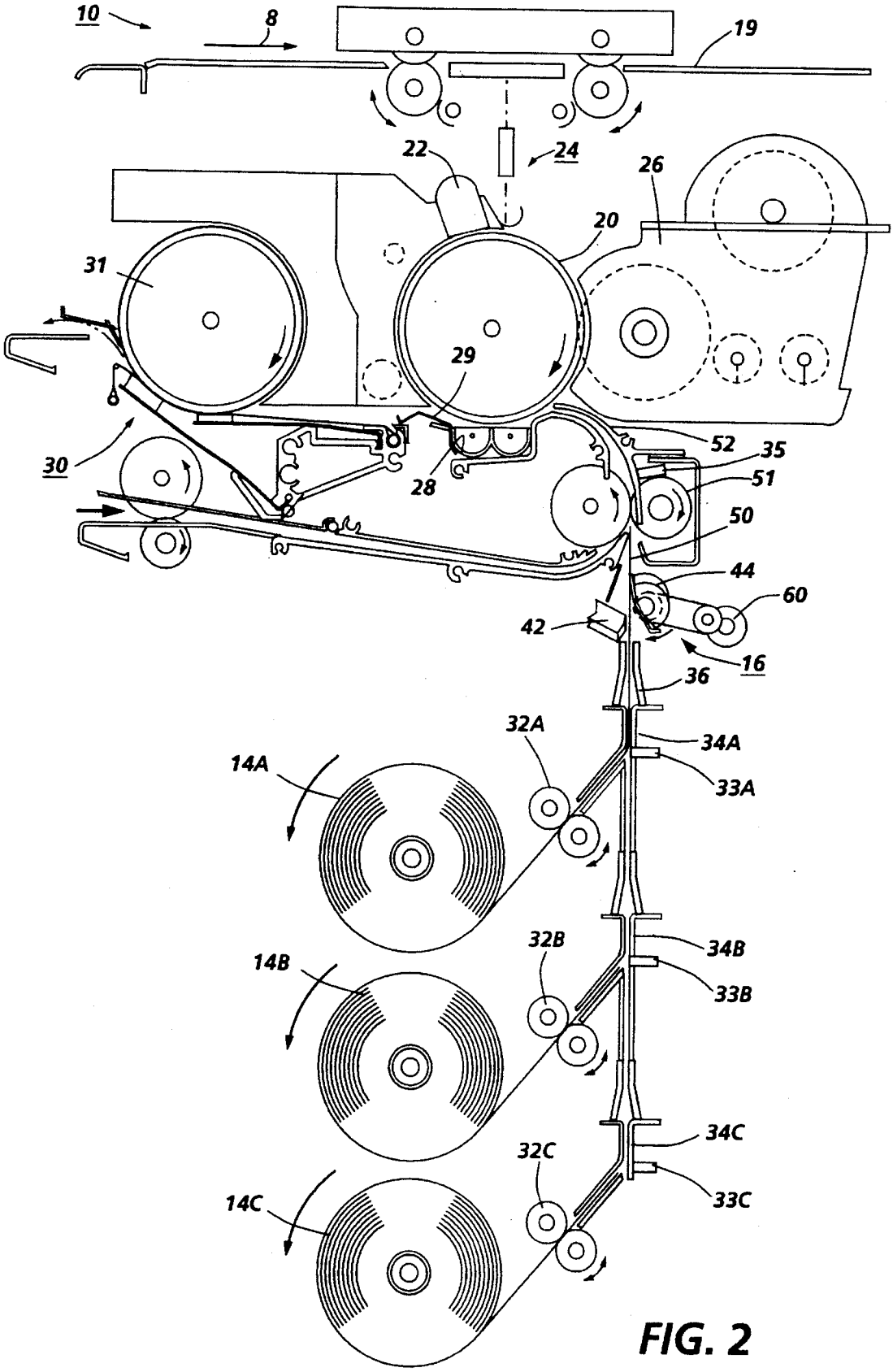

FIG. 2 partial schematic side view of the machine of FIG. 1 showing post transfer corrugator of the present invention mounted downstream of the transfer zone of the machine and before the fusing zone.

Reference will now be made in detail to the present preferred embodiment of the invention which is illustrated in the accompanying drawings.

Figure 3:
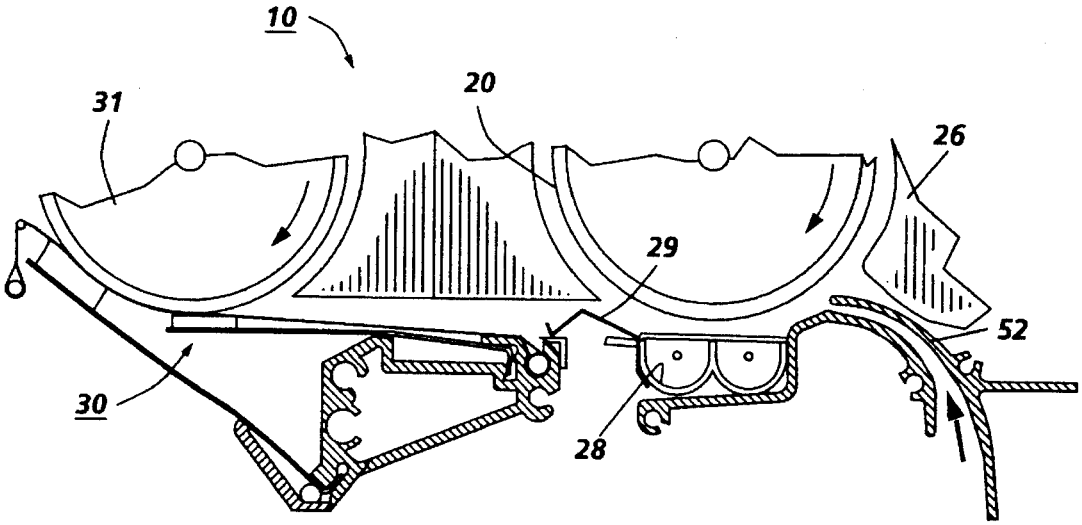

FIG. 3 is an enlarged, partial, side view showing the positioning of the post transfer corrugator shown in FIG. 2.

Referring to FIGS. 1 and 2 of the drawings there is shown by way of example an automatic xerographic reproduction or printing machine, designated generally by the numeral 10 incorporating the post transfer corrugator structure of the present invention.

Referring now to the drawings in detail wherein like numbers represent like elements, in FIG. 1 a wide format copier/printer 10 including a control panel 12 is shown which is especially adapted to copy large documents. Documents to be copied are fed in from the front of the machine, pass through an exposure zone and exit out of the back of the machine. FIG. 2 shows a side internal view of the copier/printer machine 10. Machine 10 includes an electrostatic drum 20 with xerographic stations arranged around its periphery, which carry out the operational steps of the copying process. These stations include charging station 22, exposure station 24, developing station 26, transfer station 28 and fusing station 30. Documents fed along the platen 19 in the direction of arrow 8 are imaged onto the surface of drum 20, at exposure station 24. The operations of the stations are conventional and are described, for example, in U.S. Pat. Nos. 4,821,974; 4,996,556; and 5,040,777, whose contents are incorporated herein by reference.

Copy media, which may be bond paper, vellum, or the like, is cut from the selected media roll assembly 14A, 14B or 14C and is fed by a respective feed roller pair 32A, 32B or 32C. The sheet to be cut is guided along a vertical path between baffle pairs into the sheet cutting bar assembly 16 which includes a stationary blade 42: and a rotating cutting bar 44 that includes a helical cutting blade. Cutter bar 44 is shown in the home position which is about 30° of rotation away from the cutting position and is driven by motor 60. Cutter assembly 16 is of the conventional type described, for example, in U.S. Pat. No. 4,058,037. Initiated by a cutter operation signal, bar 44 rotates in the direction of the arrow with its blade moving against blade 42 to sheer a sheet 50 from the roll media with a straight cut. The cut sheet is transported after registration by roller pair 51 into baffle 52 and then into transfer station 28 where a developed image is transferred onto the sheet. The cut sheet is then forwarded over post transfer corrugator 29, through fuser 31 at fuser station 30 and out of the machine. It is between the transfer station 28 and fuser station 30 where the problem of sheet image distortion is created by a sheet entering the fuser nip and the impact of the sheet against the fuser nip being transmitted back to the transfer zone in high humidity climates with moist paper. The fuser removes moisture from the sheet and in the process causes wrinkles in the sheet with the wrinkles creating fingerlakes deletions in the direction of paper feed that are about ½ inch wide in portions of the sheet that extend from about 6 inches from the lead edge of the sheet. The deletions are removed in accordance with the present invention by including a post transfer corrugator 29 downstream of transfer station 28. The post transfer corrugator 29 having a hump therein, is shown as a separate sheet metal baffle addition to the machine of FIGS. 2 and 3, however, a hump molded into a transport baffle that extends between the transfer station and the fuser station could be used, if desired. Either baffle configuration introduces a non-image side protrusion in the path of the sheet which forces the sheet to flatten out any distortions caused by the fuser/nip and thereby prevent any distortions in the media sheet from entering the transfer zone.

Distortions in the sheet or media could normally be transmitted back to the transfer zone which could prevent the sheet from being in the required intimate contact with the electrostatic drum 20 at the time of transfer. In addition, the post transfer corrugator 29 serves as a support for the sheet in order to prevent it from falling away from photoreceptor or electrostatic drum 20 at the 6 o'clock transfer location. Polyester 0.004 inch film, which is quite heavy compared to bond paper, is prone to this condition. Also, there is an improvement in trail edge deletions due to this added support near the transfer zone, especially with roll stock.

In operation, control and monitoring of the media are maintained from initialization to the registration roll pair by three reflective media sensors 33A, 33B, and 33C that are employed in the paper path leading to registration roll pair 51. The sensors are configured to provide a dual function. The first function of the sensors is to initialize the media to a predetermined nominal position, for example, if a new roll 14C of media is loaded into machine 10, the media lead edge is indexed into a nominal feed start position once the operator loads the media feed edge into pinch roll pair 32C. That is, after the machine doors are closed, sensor 33C is adapted to sense the lead edge of the media. If the lead edge is not detected, the media is automatically fed forward toward media sensor 33C by pinch roll pair 32C until the lead edge is detected by sensor 33C, pinch roll pair 32C is reversed by a conventional media rewind drive (not shown) for a preset time interval with the media lead edge being placed in a predetermined nominal position as shown. If media sensor 33C initially detects the lead edge of the media after the operator loads the media into the machine, pinch roll pair 32C reverses until the media lead edge uncovers the sensor and continues to rewind to the nominal position between pinch roll 32C and sensor 33C. The media initialization procedure is the same when loading media rolls 32B and 32A.

A second function of sensors 33A, 33B and 33C is to monitor progress of media through the machine's predetermined paper path during each feed cycle. The sensors 33A, 33B and 33C monitor the lead edge of the media as it is fed vertically up the media path until the lead edge of each cut sheet reaches registration sensor 35. For example, when an operator selects media roll 14C on control panel 12 and a copying cycle is initiated by the machine's conventional microprocessor controller, pinch roll pair 32C is energized and the media begins to feed toward sensor 33C. The media lead edge will be detected by sensor 33C within a predetermined window. Each of the three sensors 33A, 33B and 33C have a predetermined time window within which the media lead edge should be detected as it progresses toward registration sensor 35. If any of the three media sensors do not detect the media lead edge within the predetermined time interval, a jam is indicated and the machine is stopped automatically for operator interaction.

It should now be understood that a low cost, passive reliable and easy to implement post transfer corrugator has been disclosed that effectively increases the media wrap angle around an electrostatic drum in order to avoid media distortions originating in the fuser from causing copy deletions in sheets that are simultaneously undergoing image transfer and fusing.

While the invention has been described with reference to the structure disclosed, it is not intended that the invention be confined to the details set forth, but it is intended to cover modifications or changes as they come within the scope of the following claims.

What is claimed is:

1. A printer apparatus prevents image distortion in substrates that are simultaneously receiving an image from an imaging member and having that image fused, comprising:

a transfer station where an image is transferred to a substrate from the imaging member;

a fusing station that fuses the image to the substrate while the image is still under the influence of the transfer station and places wrinkles in the substrate by removing moisture from the substrate; and a post transfer corrugator positioned in close proximity too and immediately downstream from said transfer station, said post transfer corrugator being adapted to flatten out any wrinkles and distortions in the sheet caused by heat from said fuser station.

2. The printer apparatus of claim 1, wherein said post transfer corrugator introduces a non-image side protrusion in a path of the sheet between said transfer station and said fuser station.

3. The printer apparatus of claim 2, wherein said protrusion in the path of the sheet between said transfer station and said fuser station comprises a part of a sheet guide.

4. The printer apparatus of claim 3, wherein said sheet guide is an integral, unitary, molded member.

5. The printer apparatus of claim 1, wherein said post transfer corrugator is adapted to increase a wrap angle of the sheet around the imaging member and prevent the sheet from falling away from the imaging member.

6. In a machine which feeds large copy sheets to receive images thereon from a copy sheet tray therein, the improvement for preventing image distortion in copy sheets that are simultaneously receiving an image at a transfer station and having that image fused at a fuser station, comprising:

a post transfer corrugator positioned in close proximity too and immediately downstream from the transfer station, said post transfer corrugator being adapted to flatten out any distortions in the sheet caused by heat from the fuser station.

7. The improvement of claim 6, wherein said post transfer corrugator introduces a non-image side protrusion in a path of the sheet between said transfer station and said fuser station.

8. The improvement of claim 7, wherein said protrusion in the path of the sheet between said transfer station and said fuser station comprises a part of a sheet guide.

9. The improvement of claim 8, wherein said sheet guide is an integral, unitary, molded member.

10. The improvement of of claim 6, wherein said post transfer corrugator is adapted to increase a wrap angle of the sheet around the imaging member and prevent the sheet from falling away from the imaging member.

11. A printer apparatus which feeds large copy sheets to receive images thereon from a copy sheet tray therein includes a means for preventing image distortion in copy sheets that are simultaneously receiving an image at a transfer station and having that image fused at a fuser station, comprising: a post transfer corrugator positioned in close proximity too and immediately downstream from the transfer station, said post transfer corrugator being adapted to protrude a predetermined distance into a path of a sheet between said transfer station and said fuser station in order flatten out any distortions in the sheet caused by heat from the fuser station and thereby prevent copy sheet image deletion.

* * * * *